US005551182A

United States Patent [19]

Dahlitz et al.

[11] Patent Number: 5,551,182

[45] Date of Patent: Sep. 3, 1996

[54] BORE LIGHT

[75] Inventors: Ronald R. Dahlitz; Brent V. Dahlitz, both of Santa Fe Springs, Calif.

[73] Assignee: Buffalo Bullet Company, Inc., Santa Fe Springs, Calif.

[21] Appl. No.: 346,504

[22] Filed: Nov. 29, 1994

[51] Int. Cl.[6] ..... F41A 35/00

[52] U.S. Cl. ..... 42/90

[58] Field of Search ..... 42/90; 362/206, 362/203, 118

[56] References Cited

U.S. PATENT DOCUMENTS

| | | | |
|---|---|---|---|
| 1,236,132 | 8/1917 | Altman | 362/118 |
| 1,364,393 | 1/1921 | Madigan | 362/206 |
| 1,782,015 | 11/1930 | Sachs | 362/203 |
| 1,947,975 | 2/1934 | Dianovszky | 362/206 |
| 1,955,511 | 4/1934 | Muros | 362/206 |
| 2,180,228 | 11/1939 | Florman | 362/203 |
| 2,651,709 | 9/1953 | Ross et al. | 362/118 |
| 2,765,396 | 10/1956 | Iverson | 362/203 |
| 3,961,386 | 6/1976 | Beno | 4/247 |
| 4,907,135 | 3/1990 | Tarrson et al. | 362/109 |
| 5,211,471 | 5/1993 | Rohrs | 362/206 |

*Primary Examiner*—Harold J. Tudor
*Assistant Examiner*—Christopher K. Montgomery
*Attorney, Agent, or Firm*—Hawes & Fischer

[57] ABSTRACT

The bore light includes a conductive shell that holds a battery and receives at one end a light bulb and at the other end a cap. The cap has a shaft which, upon being screwed into the cap, will press the battery against the bulb, thereby to cause the filament of the bulb to produce illumination.

7 Claims, 1 Drawing Sheet

BORE LIGHT

The present invention relates to a bore light, and in particular to a light for illuminating the bore of a gun.

For various reasons, from time to time it is desirable to inspect the bore of a gun. To do this it is necessary to illuminate the bore, but for various reasons this may prove to be quite difficult. For example, the construction of the gun's breech mechanism, or the attachment of the gun barrel to the gun, may be such that it is difficult or impossible to adequately illuminate the bore from its breech end, or to inspect the bore from its breech end should the bore be illuminated from the muzzle end of the gun. Of course it is always possible to look into the bore of a gun barrel from the muzzle end. To inspect the bore from the muzzle, it is necessary to somehow adequately illuminate the bore. Some have developed a flashlight illuminator with a projection terminating in a bulb or lens, which projection may be deformed or is shaped to be received in the breech end of the bore, thereby to provide sufficient illumination in the bore for its inspection. In general, these devices have proven to be complex, expensive, inadequate and at times can scratch or otherwise mar the bore.

An object of the present invention is to provide an improved bore light. A further object of the present invention is to provide such a light that is simple and inexpensive in construction, and that is made from a material that will not harm the bore. These and other objects of the present invention will be apparent to those of ordinary skill in this field from the following description of a preferred embodiment of the bore light.

BRIEF SUMMARY OF THE INVENTION

The light for illuminating the bore of a gun, in its preferred construction, includes a conductive sleeve of a diameter less than the bore of a gun to be illuminated. The conductive sleeve is sized to receive therein a battery having a conductive terminal at each end. A light bulb is threaded on to one end of the conductive sleeve the light bulb has a filament connected to contact at one end, the conductive sleeve and at the other end a conductive button electrically insulated from the sleeve. A cap is threaded onto the other end of the conductive sleeve, and includes a threaded internal bore that receives a conductive shaft that is sized relative to the cap to, upon being threaded into the bore sufficiently, engage one of the conductive terminals of the battery and to force the other terminal against the light bulb's conductive button, thereby to complete the circuit from the battery to the light bulb and to cause it to produce light.

Preferably the elements of the bore light are located and positioned to not project laterally beyond the diameter of the sleeve. Also, preferably a rubber bumper is received on the outer end of the threaded shaft to engage the breech mechanism of the gun after light has been dropped from the gun's muzzle through its bore.

BRIEF DESCRIPTION OF THE DRAWINGS

The invention will be further described in connection with the accompanying drawings in which.

DETAILED DESCRIPTION

In essence, the bore light of the present invention consists of a housing which holds a battery and a light bulb, and is constructed to selectively apply electrical energy from the battery to the light bulb to cause it to illuminate. The bore light is of a diameter slightly larger than the battery and bulb, but smaller than the gun's bore, thereby permitting it to be inserted into the muzzle or chamber of a gun, and by manually tilting the gun barrel from a generally horizontal orientation towards a generally vertical orientation to cause the light to gradually slide down the barrel as the bulb illuminates the barrel while the bore is being inspected from the muzzle or chamber end.

Figure 1:
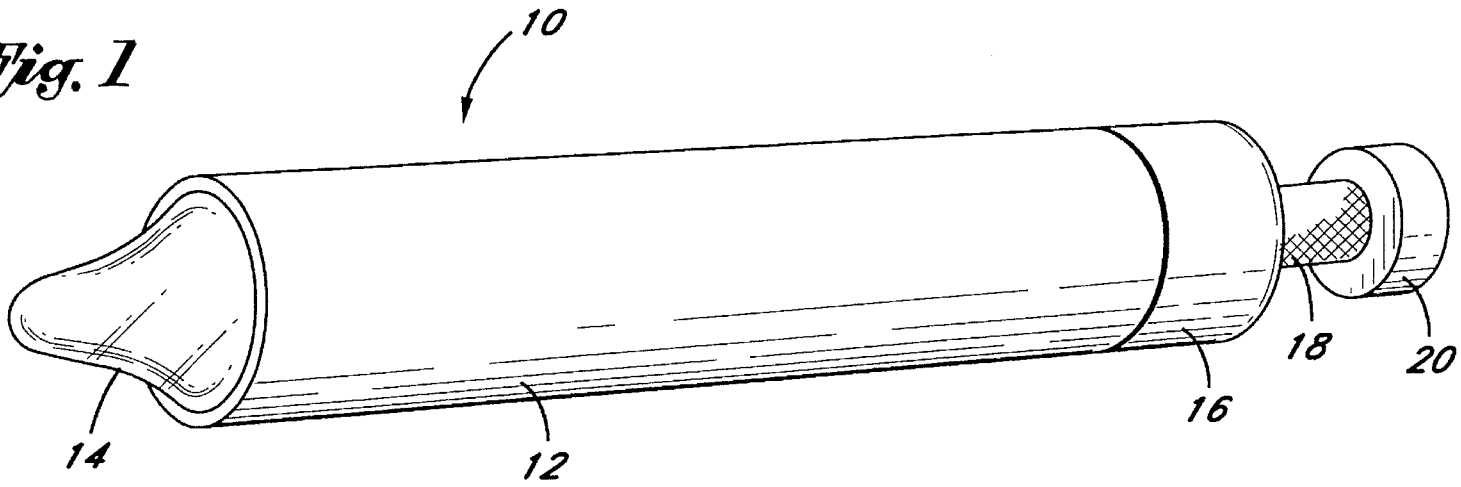
FIG. 1 is a perspective view of a preferred embodiment of the bore light.

A preferred construction of the bore light is shown in FIG. 1. In general the bore light 10 consists of a sleeve 12 which receives at one end a light bulb 14 and at the other end a cap 16 that includes a shaft 18 which terminates in a resilient bumper 20.

Figure 2:
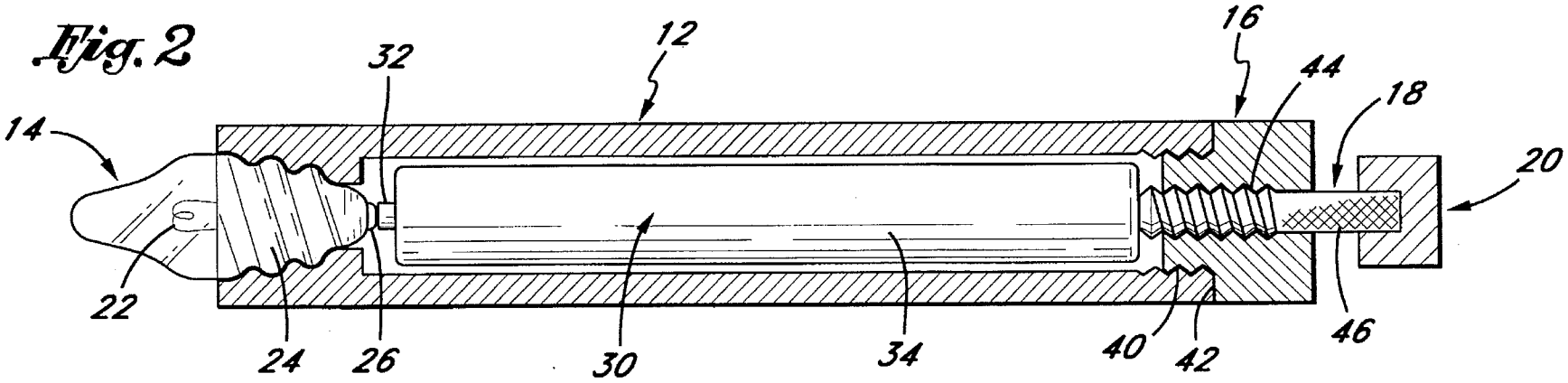
FIG. 2 is a longitudinal cross-sectional view of the preferred embodiment of the bore light.

The interrelationship of the various elements of the bore light is better shown in FIG. 2 which is a cross-section of the light taken along its major longitudinal axis. As shown in that Figure, light bulb 14 includes a filament 22 one end of which is connected to conductive shell 24 shaped to provide a threaded surface. The other end of the filament is connected to a central button 26 that is insulated from shell 24, this construction of light bulb being fairly conventional and readily available.

The threads on the outer surface of shell 24 engage a mating set of threads formed in one end of sleeve 12. Within the sleeve is an appropriate battery 30, which battery may for example be a conventional AAA style battery. It has a conductive button 32 at one end and a conductive can 34 that is electrically insulated from the button. When an electrical circuit is completed between the battery can and button the electrical potential of the battery will cause a current to flow through that circuit.

Cap 16 includes an outer cylindrical threaded portion 40 that mates with a corresponding threaded portion of sleeve 12, the cap including a shoulder 42 that abuts one end of the sleeve as shown. The cap also includes a cylindrical axial opening 44 that is threaded and receives a corresponding threaded outer surface of shaft 18. Shaft 18 is of a length sufficient to extend through the axial opening in the cap and to provide a substantial length beyond the cap, which length preferably includes knurling 46 so that it may be easily gripped and turned by the user's fingers.

Preferably the length of sleeve 12, cap 16 and light bulb 14 are such, with respect to one another, that they are slightly longer than the length of battery 30. Also, preferably the shell and cap assembly of the bore light are made of a conductive material, such as brass, that will not prove harmful in use to the bore of a gun barrel; i.e. it is not of a material harder than the interior surface of the gun barrel, or of a size that might trap abrasives between the light and gun barrel's bore.

To apply electrical power from the battery to the light bulb it is only necessary to turn shaft 18 in a direction to screw it into cap 16. When the internal end of the shaft engages the case of the battery and pushes the battery into engagement of its button 32 with button 26 on the light bulb, an electrical circuit will be completed from the case through shaft, cap and sleeve to the outer surface of the light bulb and from that surface to the light bulb's filament and its button. As a result, electrical current will flow through the filament of the light bulb causing the light bulb to produce illumination.

Once the light bulb has been turned on in this fashion, it may be inserted into the muzzle or chamber end of a gun and the gun barrel tilted to cause the light to slowly slide down the barrel. Of course, the light should be inserted into the gun barrel cap first so that the bulb faces toward the muzzle end of the gun. Thus, the user may look through the barrel of the gun as the gun is manually tilted from a generally horizontal orientation towards a vertical orientation and the bore light is caused to slide down the gun barrel, the bore light illuminating the gun barrel as it slides, permitting the user to carefully inspect the gun barrel.

Preferably a resilient bumper 20 is received on the end of the shaft 18. When the bore light has completed its passage through the gun barrel, this bumper will engage the mechanism at the breech end of the barrel and, by virtue of its resiliency, prevent any harm from being caused to that mechanism even if should bore light drops rapidly down the barrel and bangs against the mechanism.

While a preferred embodiment of the present invention has been illustrated and described, variations in the bore light will be apparent to those of ordinary skill in this field. For that reason, the scope of the invention is not defined by the preferred embodiment, but rather is as set forth in the following claims.

I claim:

1. A light for illumination of the bore of a gun, the light including the following elements:

a sleeve of a diameter less than the bore of the gun, the sleeve having a first end and a second end, the sleeve being sized to receive therein a battery having a conductive terminal at each end;

a light bulb having a filament therein for producing light when electric current passes therethrough, the light bulb having a threaded case electrically connected to one end of the filament and a central conductive button at the base end of the light bulb, the button being electrically insulated from the case and the button being electrically connected to the other end of the filament;

the sleeve having at the first end a threaded receptacle for receiving the threaded case of the light bulb with the conductive button positioned to engage one conductive terminal of a battery included in a case and to produce light at the first end of the sleeve, means for selectively completing an electrical circuit between the battery and the light bulb, said completing means at least in part pressing the battery into engagement with the light bulb; and a rubber bumper attached to and projecting beyond the second end of the sleeve and positioned to engage the breech mechanism after passage of the light through the gun's bore, whereby the bore light may be turned on by actuating the completing means and then caused to pass down the bore of a muzzle loading gun to illuminate it.

2. A light as set forth in claim 1 in which the sleeve is conductive and in which the completing means is attached to the sleeve at its second end.

3. A light as set forth in claim 2 in which the elements of the light are sized and positioned to not project laterally beyond the outer surface of the sleeve.

4. A light as set forth in claim 3 in which the completing means include first means providing a threaded internal bore at the second end of the conductive sleeve, a conductive shaft threadably received in the internal bore of said first means, the conductive shaft being sized, relative to the conductive sleeve and said first means, to upon being sufficiently threaded into the bore engage the second conductive terminal of the battery and complete the circuit to the case of the light bulb.

5. A light as set forth in claim 4 in which the first means is a threaded cap.

6. A light as set forth in claim 5 in which the rubber bumper is mounted on the end of the conductive shaft projecting beyond the conductive sleeve.

7. A light as set forth in claim 1 in which the size and outer surface of the sleeve is such that it does not harm the gun's barrel during passage therethrough.

* * * * *